US005581059A

United States Patent [19]

Chang

[11] Patent Number: 5,581,059

[45] Date of Patent: Dec. 3, 1996

[54] ROTARY SWITCH

[75] Inventor: Hsiu-lan Chang, Taipei, Taiwan

[73] Assignee: Golo Chang Company Limited, Taipei Hsien, Taiwan

[21] Appl. No.: 492,535

[22] Filed: Jun. 20, 1995

[51] Int. Cl.[6] ..... H01H 19/46

[52] U.S. Cl. ..... 200/11 G; 200/51.06

[58] Field of Search ..... 200/11 G, 51.03, 200/51.04, 51.05, 51.17, 11 R–11 TW, 51 R–51.17; 307/141–152, 139, 140

[56] References Cited

U.S. PATENT DOCUMENTS

| | | | |
|---|---|---|---|
| 2,799,743 | 7/1957 | Popp | 200/51.03 |
| 3,143,609 | 8/1964 | Fouts | 200/51.14 |
| 4,012,608 | 3/1977 | Lockard | 200/16 D |
| 4,283,107 | 8/1981 | Anthony | 200/51.17 |
| 5,113,044 | 5/1992 | Tomberlin | 200/51.04 |

*Primary Examiner*—J. R. Scott
*Attorney, Agent, or Firm*—Peterson, Wicks, Nemer & Kamrath, P.A.

[57] ABSTRACT

A rotary switch with three controlling positions in a circulating sequence of "Off", a small output, and a large output, includes a cover and a base connected with the cover. A rotor which is made of an electrically insulating material and provided with three cam parts along its circumferential periphery, is mounted in the base to rotate an electrically conductive plate with two side portions engaged with two of the cam parts. A first, second and third leaf spring respectively has a fixed end connected with an input wire, an input end of a diode, and an output wire of the switch and a free end extending toward the rotor. The fixed end of the third leaf spring is also connected with an output end of the diode. When the switch is set to the "Off" position, the first leaf spring contacts with the rotor, and the other two leaf springs contact with the conductive plate via the two side portions thereof.

8 Claims, 4 Drawing Sheets

ROTARY SWITCH

FIELD OF THE INVENTION

The present invention is related to an improved switch structure, particularly to an improved structure of a rotary switch with three controlling positions for controlling the output of an electric appliance, for example, an electric fan.

BACKGROUND OF THE INVENTION

Refer to FIG. 6 of the present application, which shows the structure of a prior art switch of the type that the present invention is concerned. The switch comprises a base 90 to receive a first electric wire 920 connected to a power source (not shown), a second electric wire 930 directly connected to an electric appliance (not shown), for example, an electric fan, a third electric wire 940 also connected to the electric appliance but via a diode 95, and a rotor 91 (which is formed of an insulating material) rotatably mounted on the base and drivable by a knob (not shown) connected thereto. Three contacts 910 are respectively received in recesses defined in a periphery of the rotor 91 to rotate therewith, wherein each of the contacts is electrically connected with each other. A first, second and third leaf spring 92, 93 and 94 are mounted on the base 90 to respectively connect with the first, second and third electric wires 920, 930 and 940 and extend toward the rotor 91. As shown in FIG. 6, when the rotor 91 is at this position, the wire 920 is simultaneously electrically connected with the wires 930 and 940 through the contacts 910; in this case, due to the impedance of the diode 95, most of the electric current from the wire 920 is introduced into the appliance through the wire 930. As the rotor 91 is rotated clockwise for ¼ turn from the shown position, the leaf spring 94 becomes separated from the contacts 910; therefore, the electric current from the wire 920 is totally introduced into the appliance through the wire 930. As the rotor 91 is further rotated clockwise for ¼ turn, the leaf spring 93 becomes separated from the contacts 910; therefore, the electric current from the wire 920 is solely introduced into the appliance through the wire 940 and the diode 95. Due to the impedance of the diode 95, the amount of voltage across the appliance at this point is reduced to a significant level in comparison with the above two cases, whereby the appliance can have a smaller output (for example, if the appliance is an electric fan, it may have a lower speed of rotation.) Finally, when the rotor 91 is further rotated for ¼ turn, the wire 920 is separated from the contacts 910; thus, no current will flow into the appliance. At this point the knob indicates "Off".

Although the prior art switch has four controlling positions (including the "Off" position), its first position (as shown by FIG. 6) and the following position cause substantially the same amount of current introduced into the appliance, which, in turn, causes the appliance to have substantially the same level of output at these two positions. Therefore, one of the two controlling positions is superfluous.

Secondly, since the prior art switch is rotated to adjust the output of the appliance from a large output to a small output, this is disadvantageous from the view of energy conservation.

Thirdly, since the diode of the prior art switch is mounted outside of the base, the structure of the prior art switch cannot achieve a compact fashion.

SUMMARY OF THE INVENTION

It is an objective of the present invention to provide a rotary switch with three controlling positions to control three different levels of output of an electric appliance incorporating the switch.

A further objective of the present invention is to provide such a switch wherein the controlling of the output is circulated at a sequence, i.e., from an "Off" position with no output, then a first position with a small level of output, to a second position with a large level of output.

A still further objective of the present invention is to provide such a switch with a compact construction.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
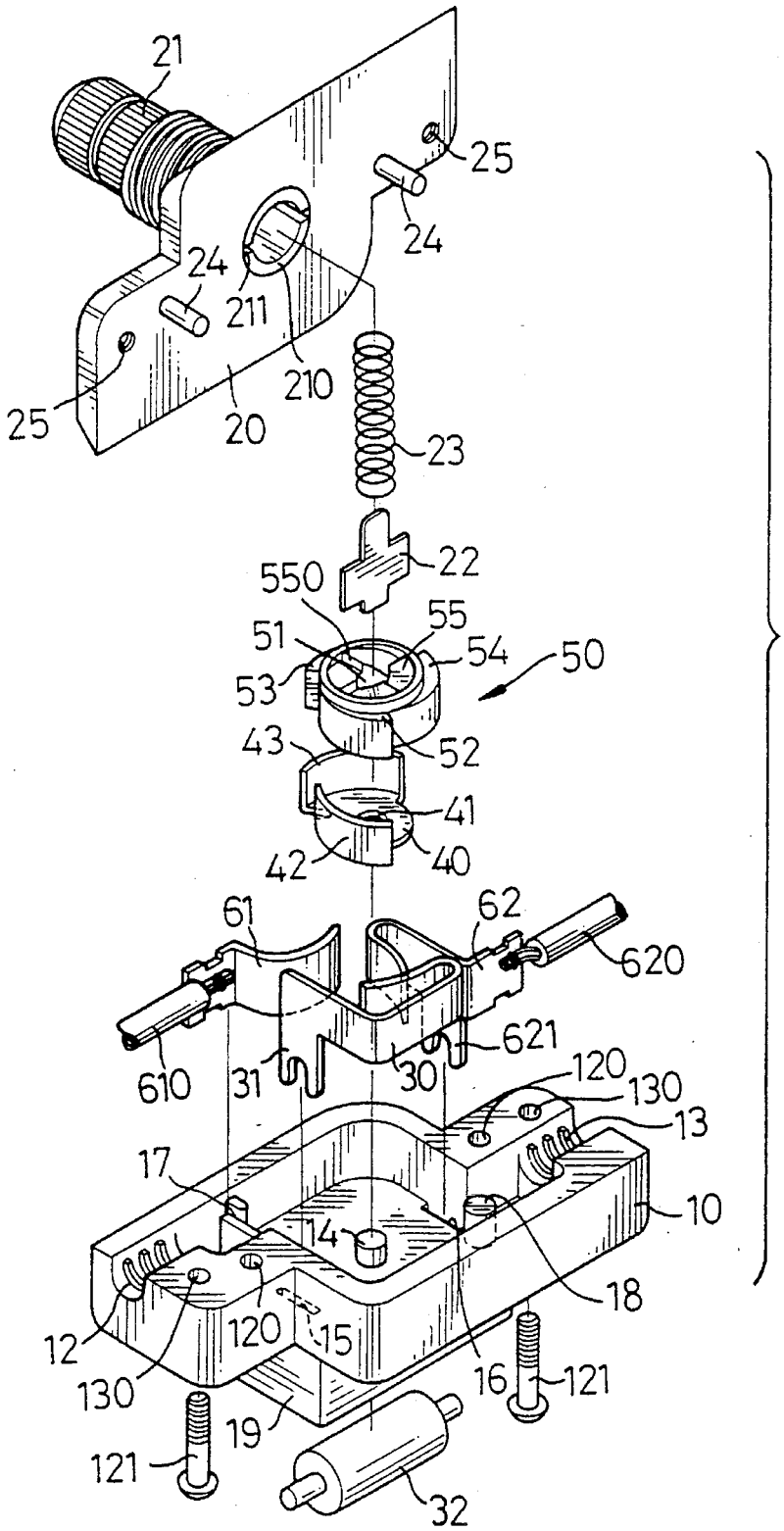
FIG. 1 is a top-left-front perspective and exploded view showing the parts constituting a rotary switch in accordance with the present invention.
Figure 5:
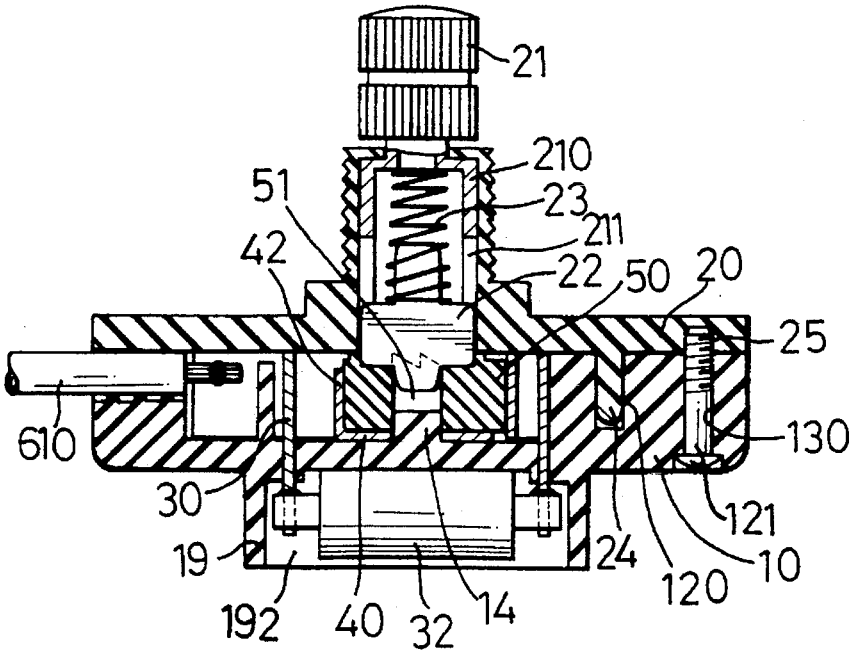
FIG. 5 is an elevational, cross-sectional view generally taken from line 5—5 of FIG. 2, showing the present switch in an assembled state including the cover and its related parts.
Figure 6:
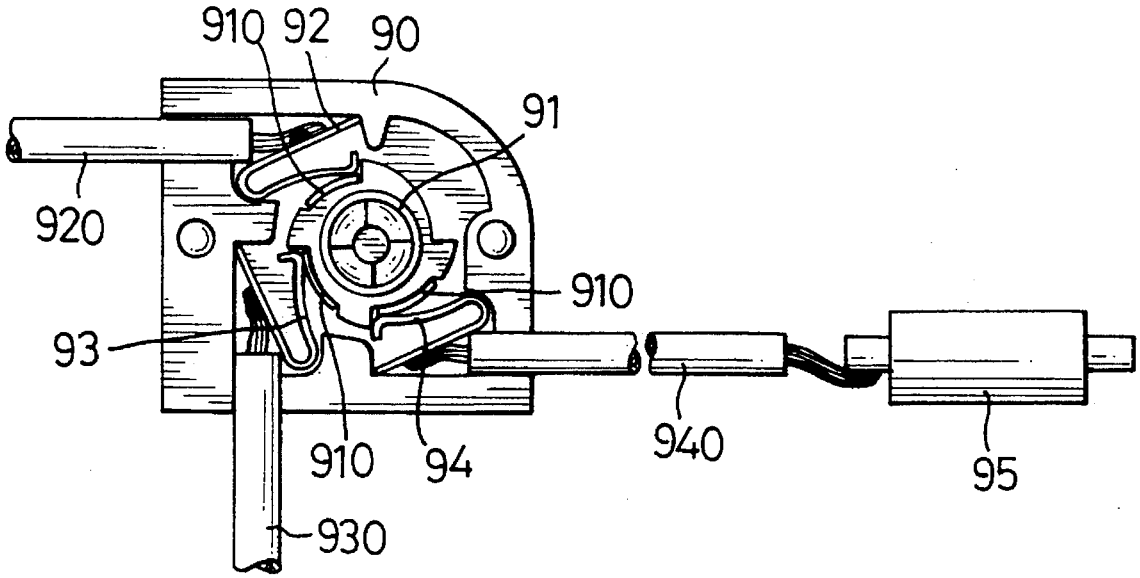
FIG. 6 PRIOR ART
FIG. 6 is a view similar to FIG. 2, but showing the structure of a prior art switch of the type that the present invention is concerned.

Simultaneously referring to FIGS. 1 and 5, a rotary switch in accordance with the present invention is mainly consisted of a cover 20, a spring 23, a cruciform driving plate 22, a rotor 50 made of an electrically insulating material, an electrically conductive plate 40, three leaf springs 61, 30, 62 made of an electrically conductive material, a base 10, two screws 121 and a diode 32, wherein the leaf spring 61 is connected with an electric wire 610, and the leaf spring 62 is connected with another electric wire 620.

The cover 20 includes a knob 21 rotatably fixed thereon, two locating pins 24, two threaded holes 25, and a sleeve 210 with a pair of opposite slits 211 integrally formed with the knob 21 and rotatable therewith. The rotor 50 has a top face consisted of four slanted segments 55 defining two pairs of opposed vertical edges 550, three side cam parts 52, 53 and 54 formed along a circumferential periphery thereof and a central hole 51. The conductive plate 40 has two side upright portions 42 and 43 and a central hole 41. The leaf springs 30 and 62 respectively have downward extensions 31 and 621. The base 10 has a first passage 12 for receiving the wire 610 and a second passage 13 for receiving the wire 620, two holes 120 for receiving the locating pins 24, two other holes 130 for receiving the screws 121, two slits 15 and 16 respectively for the passing through the extensions 31 and 621, a protrusion 14 for positioning the conductive plate 40 and the rotor 50 by engaging with the central holes 41 and 51 thereof, a stopping plate 17 for restricting the movement of the leaf spring 61, a stopping post 18 for restricting the movement of the leaf spring 62, and lower walls 19 defining a lower chamber 192 for accommodating the diode 32.

Particularly referring to FIG. 5, which shows that the parts constituting the present switch are assembled together, the cover 20 is fitted to the base 10 by inserting the locating pins 24 into the holes 120 and extending the screws 121 through the holes 130 to engage with the threaded holes 25. The wire 610 is mounted in the first passage 12 and the downward extension 31 of the leaf spring 30 is mounted to pass through the slit 15 and has an end soldered with a cathode of the diode 32 located in the lower chamber 192 defined by the walls 19. An anode of the diode 32 is soldered to the downward extension 621 of the leaf spring 62 passing through the slit 16. The conductive plate 40 and the rotor 50 are mounted on the protrusion 14 by their respective holes 41 and 51 engaging therewith, whereby the conductive plate 40 and the rotor 50 can rotate about the protrusion 14. The driving plate 22 has a bottom portion inserted into an upper portion of the hole 51 and two side portions having upper portions respectively received within the slits 211 and lower portions abutting a pair of opposed vertical edges 550 defined by the segments 55 constituting the top surface of the rotor 50. The spring 23 is compressed between the driving plate 22 and the sleeve 210 thereby to exert a pushing force to urge the driving plate toward the rotor 50. Since the sleeve 210 is rotatable with the knob 21, when the knob 21 is rotated by an external force, the sleeve 210 is rotated to drive the rotation of the driving plate 22 via an engagement between the driving plate 22 and the slits 211 of the sleeve 210, and, then, the rotor 50 via an engagement between the driving plate 22 and a pair of the vertical edges 550 of the segments 55 of the rotor 50 and the conductive plate 40, which will be further discussed below.

Figure 2:
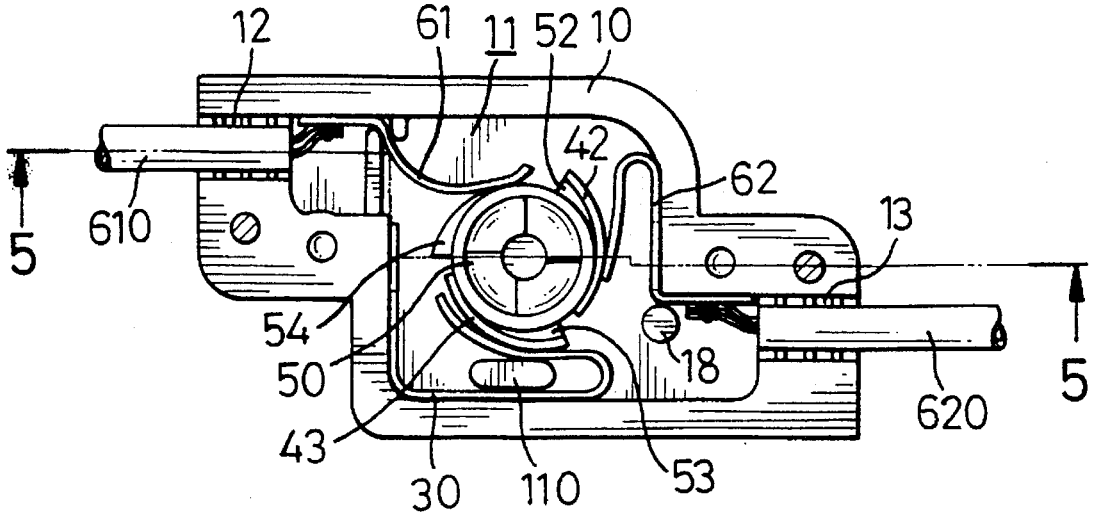
FIG. 2 is a top view of FIG. 1 to show the present switch in an assembled state with a cover and its related parts removed to facilitate the understanding of the inner structure of the present switch.

Now turning to FIG. 2, the base 10 defines an upper chamber 11 located above the lower chamber 192 defined by the walls 19 for receiving the diode 32 to receive a part of the leaf spring 61, the rotor 50, the conductive plate 40, the leaf spring 30 and a part of the leaf spring 62. The leaf spring 61 is configurated to have an end fixedly attached with the wire 610, a generally intermediate portion passing through and restricted by the stopping plate 17 and a free end curved toward the rotor 50 and contacted with the cam part 54 thereof. The leaf spring 30 is configurated to generally have an L-shape with its bottom free end located on the horizontal side bent toward its vertical side and surrounding a constraining plate 110 and having a curvature generally conforming the curvature of the upright side portion 43 of the conductive plate 40, and top fixed end defining the downward extension 31 connected with the diode 32. The leaf spring 62 is also configurated to generally have an L-shape but with its top free end located on the vertical side bent toward its horizontal side and away from its bottom fixed end connected with the wire 620. The L-shaped leaf spring 62 has an intermediate portion passing through and constrained by the stopping post 18.

From FIG. 2, it can be seen that due to the cooperative configuration between the rotor 50 and the upright side portions 42 and 43 of the conductive plate 40 (i.e., the side portions 42, 43 being so configurated to respectively closely contact a length of the circumferential periphery of the rotor 50 and the cam parts 52, 53), when the rotor 50 is rotated clockwise, it can drive the rotation of the conductive plate 40 by the cam part 52 engaging the side portion 42 and the cam part 53 engaging the side portion 43. The side portions 42 and 43 of the conductive plate 40 are used as movable contact segments which engage selected free ends of the conductive leaf springs 61, 30, 62. When the rotor 50 is rotated counterclockwise, the rotation will be stopped when edges of the cam parts 52, 53 and 54 are blocked by the free ends of the leaf springs 61, 30 and 62.

As shown in FIG. 2, when the rotor 50 is rotated by the knob 21 through the sleeve 210 and the driving plate 22 to this shown location, the leaf spring 61 contacts with the campart 54 of the rotor 50, which is made of an electrically insulating material; thus, no power from the power source (not shown) connected with wire 610 will be transmitted from the wire 610 through the conductive plate 40 to the wire 620 connected with an electric appliance (for example, an electric fan).

Figure 3:
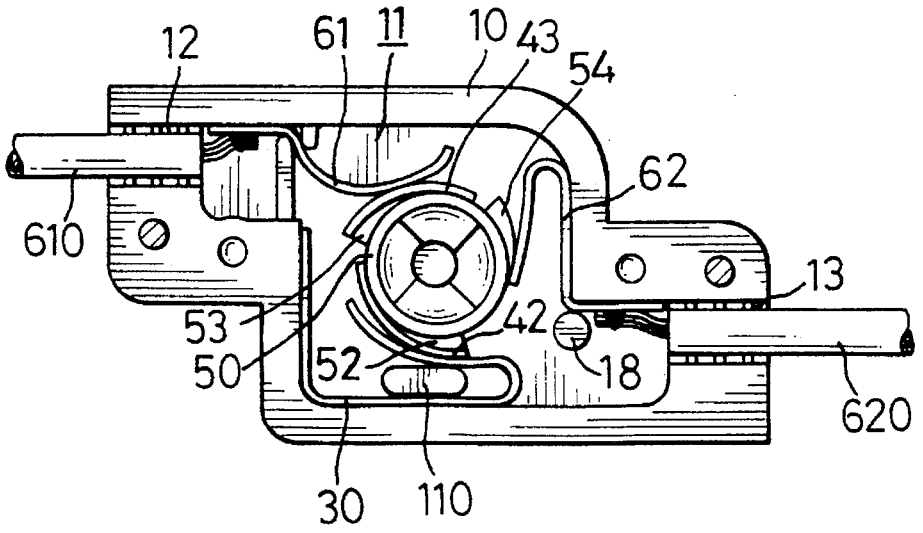
FIG. 3 is a view similar to FIG. 2, but with a rotor being rotated about 120° clockwise from the position of FIG. 2.

As the knob 21 is rotated to rotate the rotor 50 clockwise about 120° to the location as shown by FIG. 3, the side portion 43 is rotated with the cam part 53 to engage with the leaf spring 61, the leaf spring 62 is separated from the side portion 42 and contacts with the insulating cam part 54, and the leaf spring 30 engage the side portion 42, which is rotated with the cam part 52. In this situation, the electric current coming from the power source will flow through the wire 610, the leaf spring 61, the side portion 43 of the conductive plate 40 to the side portion 42 thereof, and, then, following the path consisted of the leaf spring 30, its downward extension 31, the diode 32 (better seen in FIG. 5), the downward extension 621 of the leaf spring 62, and finally the wire 620 to the appliance connected therewith. Here, due to the function of the diode 32, the voltage across the appliance at this point is reduced by a predetermined amount; thus, the output of the appliance is in a lower level.

Figure 4:
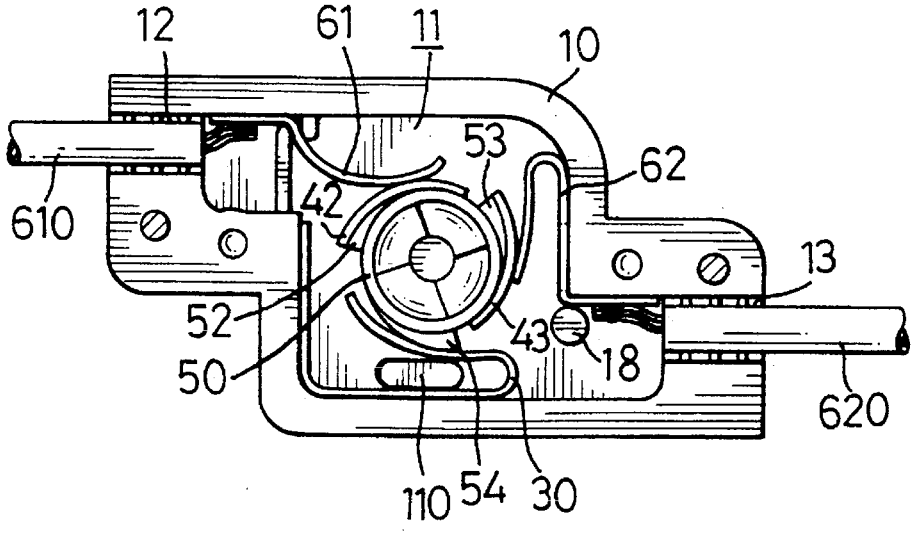
FIG. 4 is a view similar to FIG. 3, but with the rotor being further rotated about 120°.

As the knob 21 is further rotated clockwise about 120° from the position of FIG. 3 to the position of FIG. 4, it can be seen from FIG. 4 that the side portion 43 is rotated to engage the leaf spring 62, the side portion 42 is rotated to engage the leaf spring 61 and the insulating cam part 52 is rotated to contact with the leaf spring 30. At this point, the electric current coming from the power source is directly (i.e., without passing through the diode 32) transmitted to the appliance through the wire 610, the leaf spring 61, the side portions 42, 43 of the conductive plate 40, the leaf spring 62 and the wire 620. Thus, the electric current is fully transmitted into the appliance, and the appliance may have a large level of output.

As the knob is further rotated about 120° from the position as shown in FIG. 4, the switch is returned to its "Off" position as shown in FIG. 2.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotary switch with three controlling positions in a circulation sequence for controlling an electrical appliance to have a zero, small and large outputs, said switch comprising:

a housing;

an electrical input line fixedly mounted on the housing, connected to a power source and defining a first end extending into the housing;

an electrical output line fixedly mounted on the housing, connected to the electrical appliance and defining a second end extending into the housing and spaced from the first end;

an electrical branch comprising a diode having an anode electrically connected with an electrical output line and a cathode defining a third end extending into the housing and spaced from the first and second ends a distance;

a rotary switching means rotatably mounted in the housing, located between with the first, second and third ends and engaged therewith for electrically disconnecting the first end from the second and third ends when the switch is set to the position in which the appliance has a zero output, for electrically connecting the first end and the third end and disconnecting the first end and the second end when the switch is sequentially set to the position in which the appliance has a small output, and for electrically connecting the first end and the second end and disconnecting the first end and the third end when the switch is further set to the position in which the appliance has a large output.

2. A rotary switch according to claim 1, wherein the rotary switching means comprises an insulating portion and two conductive portions electrically connected with each other, the first, second and third ends respectively comprise a conductive leaf spring defining a free end extending toward the rotary switching means to engage therewith, and wherein when the switch is set to the position in which the appliance has a zero output, the insulating portion engages the free end of the conductive leaf spring of the first end of the input line and the two conductive portions engage respectively with the free ends of the conductive leaf springs of the second and third ends of the output line and the branch.

3. A rotary switch according to claim 1, wherein the rotary switching means comprises a rotor made of an insulating material and a conductive plate rotatable together with the rotor and having at least two side portions spaced with each other, and wherein when the switch is set to the position in which the appliance has a zero output, an exposed insulation portion of the rotor engages the first end of the input line and the two sides portions of the conductive plate engage respectively the second and third ends of the output line and the branch.

4. A rotary switch according to claim 1, wherein the first, second and third ends of the input line, output line and branch respectively comprise a conductive leaf spring defining a free end extending toward the rotary switching means to engage therewith.

5. A rotary switch with three controlling positions in a circulation sequence for controlling an electrical appliance to have a zero, small and large outputs, said switch comprising:

a housing defining a first and second chamber;

a diode received in the second chamber;

an insulating rotor rotatably mounted in the first chamber;

a conductive plate having two side portions spaced from each other and engaged with the rotor such that when the rotor is rotated, the conductive plate is rotated therewith;

a first conductive leaf spring having a fixed end connected with an input electric wire and a free end extending into the first chamber and toward the rotor;

a second conductive leaf spring located substantially in the first chamber, having a fixed end extending into the second chamber and connected with a cathode of the diode and a free end extending toward the rotor;

a third conductive leaf spring having a fixed end defining a first portion connected with an output electric wire and a second portion extending into the second chamber and connected with an anode of the diode, and a free end extending toward the rotor;

a rotation generating means rotatably mounted on the housing, defining a first portion for receiving an outer rotating force and a second portion for drivably engaging the rotor so that when the rotation generating means is rotated by the outer rotating force, the rotor and the conductive plate are rotated therewith;

said rotation generating means rotating the rotor and the conductive plate to cause the first leaf spring to engage the rotor and the other two leaf springs to engage the conductive plate through its two side portions respectively when the switch is set to the position in which the appliance has a zero output; said rotation generating means rotating the rotor and the conductive plate to cause the third leaf spring to engage the rotor and the other two leaf springs to engage the conductive plate through its two side portions respectively when the switch is sequentially set to the position in which the appliance has a small output position; and said rotation generating means rotating the rotor and the conductive plate to cause the second leaf spring to engage the rotor and the other two leaf springs to engage the conductive plate through its two side portions respectively when the switch is further set to the position in which the appliance has a large output.

6. A rotary switch according to claim 5, wherein the housing comprises a cover and a base connected to the cover.

7. A rotary switch according to claim 6, wherein the first and second chambers are defined in the base and the first chamber is located between the cover and the second chamber when the cover and base are connected together.

8. A rotary switch according to claim 6, wherein the rotation generating means comprises a knob rotatably mounted on the cover, a plate configurated to have an end engaged with the knob and another end engaged with the rotor and a spring compressed between the knob and the plate to exert a pushing force to urge the plate toward the rotor.

* * * * *

US005581059C1

(12) EX PARTE REEXAMINATION CERTIFICATE (5123rd)

United States Patent
Chang

(10) Number: US 5,581,059 C1
(45) Certificate Issued: Jun. 21, 2005

(54) ROTARY SWITCH

(75) Inventor: Hsiu-lan Chang, Taipei (TW)

(73) Assignee: Golo Chang Company Limited, Taipei Hsien (TW)

Reexamination Request:
No. 90/005,503, Sep. 23, 1999

Reexamination Certificate for:

| | |
|---|---|
| Patent No.: | **5,581,059** |
| Issued: | **Dec. 3, 1996** |
| Appl. No.: | **08/492,535** |
| Filed: | **Jun. 20, 1995** |

(51) Int. Cl.[7] ..... H01H 19/46
(52) U.S. Cl. ..... 200/11 G; 200/51.06
(58) Field of Search ..... 200/11 R–11 TW, 200/51.03–51.05, 51.97; 307/141–152, 139, 140

(56) References Cited

U.S. PATENT DOCUMENTS

| | | | |
|---|---|---|---|
| 2,799,743 A | 7/1957 | Popp | 200/51.03 |
| 3,143,609 A | 8/1964 | Fouts | 200/51.14 |
| 4,012,608 A | 3/1977 | Lockard | 200/16 D |
| 4,283,107 A | 8/1981 | Anthony | 339/147 R |
| 5,113,044 A | 5/1992 | Tomberlin | 200/51.04 |

FOREIGN PATENT DOCUMENTS

| | | | |
|---|---|---|---|
| TW | 83 208 198 | 11/1994 | H01H/17/18 |

*Primary Examiner*—Michael A. Friedhofer

(57) ABSTRACT

A rotary switch with three controlling positions in a circulating sequence of "Off", a small output, and a large output, includes a cover and a base connected with the cover. A rotor which is made of an electrically insulating material and provided with three cam parts along its circumferential periphery, is mounted in the base to rotate an electrically conductive plate with two side portions engaged with two of the cam parts. A first, second and third leaf spring respectively has a fixed end connected with an input wire, an input end of a diode, and an output wire of the switch and a free end extending toward the rotor. The fixed end of the third leaf spring is also connected with an output end of the diode. When the switch is set to the "Off" position, the first leaf spring contacts with the rotor, and the other two leaf springs contact with the conductive plate via the two side portions thereof.

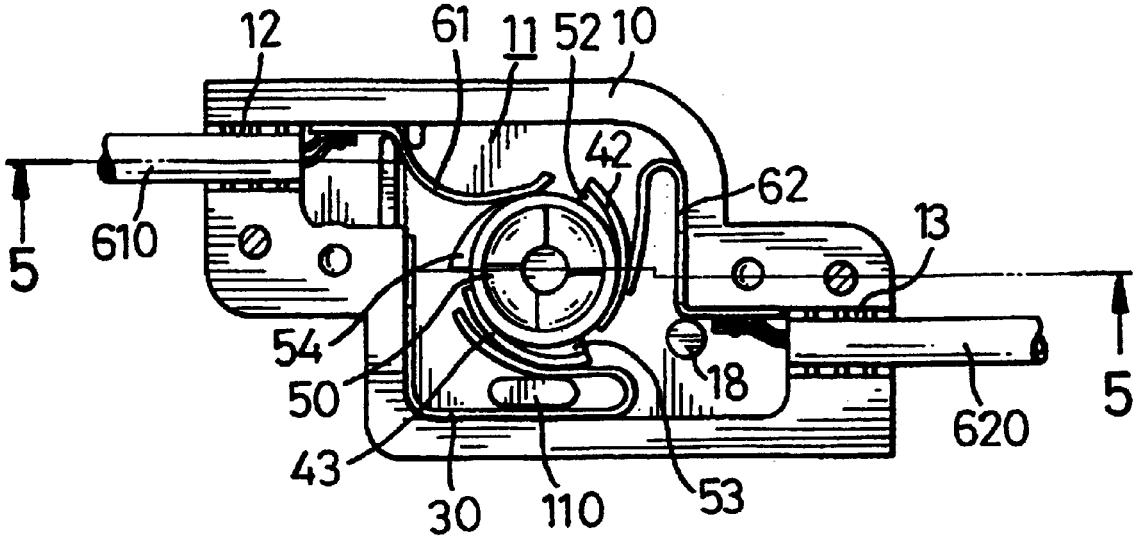

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *